United States Patent [19]

Satake

[11] Patent Number: 4,765,489

[45] Date of Patent: Aug. 23, 1988

[54] SEPARATION WALL MOVEMENT CONTROL DEVICE FOR GRAIN SORTING MACHINES

[75] Inventor: Toshihiko Satake, Hiroshima, Japan

[73] Assignee: Satake Engineering Co., Ltd., Tokyo, Japan

[21] Appl. No.: 175,756

[22] PCT Filed: Jan. 31, 1980

[86] PCT No.: PCT/JP80/00016

§ 371 Date: Aug. 6, 1980

§ 102(e) Date: Aug. 6, 1980

[87] PCT Pub. No.: WO80/01543

PCT Pub. Date: Aug. 7, 1980

[30] Foreign Application Priority Data

Feb. 2, 1979 [JP] Japan ..... 54-11547

[51] Int. Cl.[4] ..... B07C 5/00; B07C 5/36

[52] U.S. Cl. ..... 209/557; 209/587; 209/694

[58] Field of Search ..... 209/45, 552, 557, 576, 209/577, 578, 580, 581, 587, 588, 635, 691, 694, 696, 700, 707

[56] References Cited

U.S. PATENT DOCUMENTS 3,807,554 4/1974 Satake ..... 209/694
3,933,249 1/1976 Welsh et al. ..... 209/557
4,301,931 11/1981 Satake ..... 209/691

FOREIGN PATENT DOCUMENTS 48-26146 8/1973 Japan .
54-129567 10/1979 Japan ..... 209/691
1012436 12/1965 United Kingdom ..... 209/694

*Primary Examiner*—Robert B. Reeves
*Assistant Examiner*—Edward M. Wacyra
*Attorney, Agent, or Firm*—Lowe, Price, LeBlanc, Becker & Shur

[57] ABSTRACT

The invention relates to a separation wall movement control device for grain sorting machines designed to separate mixed grain of different kinds which give different responses to light by the rough surface grain sorting plate, the separation wall being designed to move or stop along one side of a rough surface grain sorting plate. A detector consisting of many LED light sources and light receiving elements is provided facing one or both sides of a grain exit passage of the rough surface grain sorting plate. The mixing ratio of grain flowing out through the grain exit passage of the rough surface grain sorting plate is detected, the detector sends a signal through the control circuit to the motor communicating with the separation wall provided at a distance in the direction of movement of the detector, and the separation wall is moved to the boundary between pure grains and mixed grains and is stopped there.

1 Claim, 2 Drawing Sheets

SEPARATION WALL MOVEMENT CONTROL DEVICE FOR GRAIN SORTING MACHINES

RELATED APPLICATIONS

This application is related to application Ser. No. 188,369, filed Sept. 18, 1980, now U.S. Pat. No. 4,727,990.

TECHNICAL FIELD

The present invention relates to a separation wall movement control device applicable to different kinds of grain which give different responses to light in the grain sorting machines.

BACKGROUND ART

Conventional grain sorting machines have a rough grain sorting plate provided horizontally at the front and rear sides or with the front part raised and in a laterally sloped position. Sorting plates of this type are vibrated so as to shake up the grains at an average oscillation angle larger than the slope elevation angle. In other grain sorting machines air is blown through holes in the grain sorting plate without vibrating. In operation, a mixture of unhulled rice and unpolished rice is, for example, supplied onto said sorting plate, and different kinds of grain are collected at the front or rear side of said sorting plate, the different kinds of grains being separated by a separation wall provided beside said sorting plate. Finally, the grain is caused to flow out in a lateral direction. The distribution of grains on the sorting plate varies according to the amount and quality of mixed grain supplied. In addition, the greater the slop elevation angle of the sorting plate, the more the grain drifts to the rear part, and the greater the average oscillation angle, number of vibrations, or amplitude, the more the grain drifts to the front.

Accordingly, since the boundary of the different kinds of sorted grains e.g., unhulled rice, mixture of unhulled rice and unpolished rice, and unpolished rice, moves on the sorting plate, the separating wall for separating these different kinds of grains must be moved along an edge of the sorting plate.

As shown in Laying-open Pat. No. 51-47651, it has been the conventional practice to manually move the sorting wall along an edge of the sorting plate when the boundary of the different kinds of grains no longer coincides with the previous boundaries on the sorting plate, by observing the state of grain distribution on the sorting plate.

However, it is difficult to discern the boundary between unpolished grain and a mixture of unpolished grain and unhulled grain. If the boundary moves frequently, moving the separation wall is very troublesome. In particular, in the case of an oscillating type grain sorting machine, the machine must be stopped each time the separation wall is to be moved. Because of these disadvantages, work efficiency is very low.

DISCLOSURE OF INVENTION

An object of the present invention is to provide a grain sorting machine separation wall movement control device of high work efficiency characterized by highly accurate detection of the mixing ratio of the different kinds of grains giving different responses to light, the distribution status of the grain flowing through the grain exit passage of the grain sorting plate being automatically detected, and the separation wall being positioned to properly align with the boundary of the different kinds of grain according to the detection signal without use of the human hand.

In order to achieve the above-mentioned object, the present invention provides a separation wall movement control device for grain sorting machines wherein the separating wall is designed to move and stop along one side of the rough surface grain sorting plate, which is characterized by a separation wall having a detecting device consisting of many pairs of light sources and light receiving elements facing the grain exit passage of the rough grain sorting plate in the grain sorting machine, said separation wall being electrically connected with a driving unit and a detector via a control circuit.

Another object of the present invention is to provide a separation wall movement control device for grain sorting machines wherein light sources and light receiving elements are provided on each side of the grain exit passage.

Still another object of the present invention is to provide a separation wall movement control device for grain sorting machines wherein light sources and light receiving elements are provided on the same side of the grain exit passage.

Still another object of the present invention is to provide a separation wall movement control device for grain sorting machines wherein light sources and light receiving elements are alternately arranged.

Still another object of the present invention is to provide a separation wall movement control device for grain sorting machines wherein the light source used is a light-emitting diode (LED).

Stil another object of the present invention is to provide a separation wall movement control device for grain sorting machines wherein the separation wall and the detector are spaced apart along the direction of movement of said separation wall.

BEST MODE FOR CARRYING OUT THE INVENTION

Figure 1:
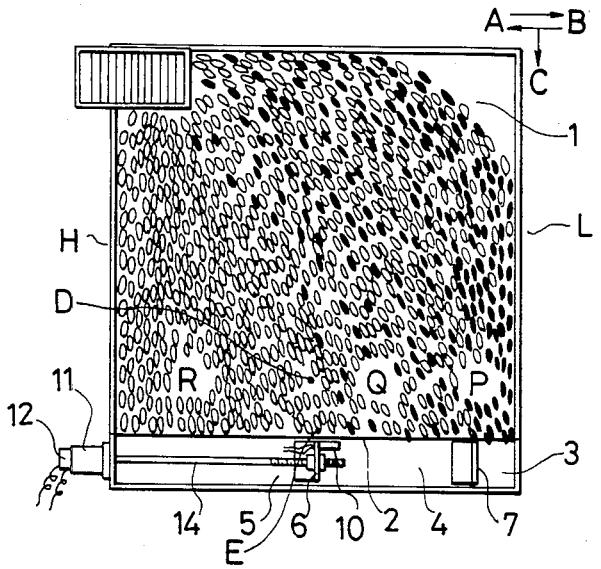
FIG. 1 is a plan view of a grain sorting machine according to the present invention.
Figure 2:
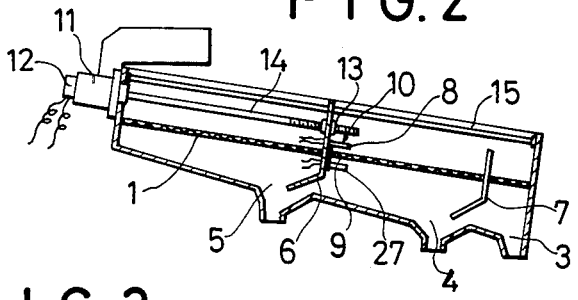
FIG. 2 is a side sectional view of FIG. 1.
Figure 3:
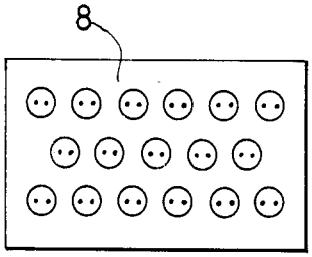
FIG. 3 is a plan view of the light source side of the detector.
Figure 4:
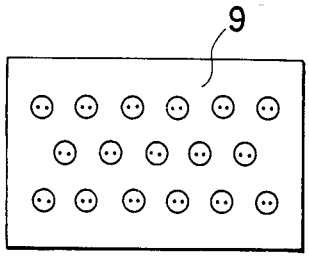
FIG. 4 is a plan view of the light receiving element side of the detector.
Figure 5:
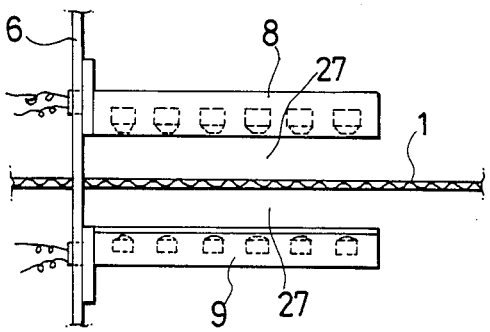
FIG. 5 is a side view of the detector.

Referring to FIGS. 1 to 5, a rough surface grain sorting plate 1 is provided so that side A is raised and side B is lowered (FIG. 1) to make a slope in the A to B direction; side C is lowered and the plate 1 is vibrated at a magnitute greater than the slope angle around the plane of inclination.

Onto the rough surface grain sorting plate vibrating diagonally up and down is supplied a mixture of different kinds of grain, e.g., unhulled rice and unpolished rice, that give different responses to light. The unpolished rice mass R of small friction coefficient is caused to drift toward side H (raised side), the unhulled rice mass P of large friction coefficient is caused to drift toward side L (lowered side), and in the process both masses flow toward side C on the plate 1. The mixture mass Q flows between the masses R and P toward side C, and these three masses are separately discharged from an end 2 of the plate 1, unhulled rice, a mixture of rice, and unpolished rice are separately directed to respective exit passages 3, 4 and 5 through separation walls 6 and 7 which move and stop along a side of the plate end 2.

A detector 10 consists of LED light sources 8 of light-emitting diodes provided at E where the rice grain mass is located along the boundary D of between the unpolished rice mass R of side H and the mixture Q flowing near the plate end 2 and the light receiving elements 9, for detecting light projected from the light sources 8. The detector faces the grain exit passage 27 through which sorted grain passes, and is integrally mounted with the separation wall 6 on both sides of the grain exit passage 27. The detector 10 moves with the separation wall 6 which moves along one side of the plate end 2 of the plate 1, and the separation wall 6 is aligned with the boundary between unpolished and mixture rice masses and is stopped there. In this case, a standard value of grain mixture is set wherein a slight amount of unhulled rice is mixed with unpolished rice, e.g., the mixing percentage of unhulled rice being 3% to 5%. The detector 10 moves to side R (unpolished rice mass) when the mixing ratio exceeds this set value, and it moves to side Q (mixed rice mass) when the mixing ratio is below the standard. This movement is automatically adjusted until the mixing ratio meets the standard, and position of the separation wall 6 is thus determined. In this case, it is normal to space the separation wall slightly to the side of the unpolished rice mass R from the position of the standard point, thus providing a boundary point where no unhulled rice is present in the unpolished rice, and compensating for the deviation inherent in a 3% to 5% mixing ratio of unhulled rice to unpolished rice. The movements of the detector 10 and separation wall 6 are controlled by an electric control circuit 12 connecting the light receiving elements of the detector 10 with a reversible motor 11. The separation wall 6 is directly coupled with the reversible motor 11 which is a drive unit provided on the mounting frame of plate 1 having a bolt shank 14 screwed through a screw hole 13 drilled in the separation wall 6. The separation wall 6 is mounted in a guiderail 15.

Figure 6:
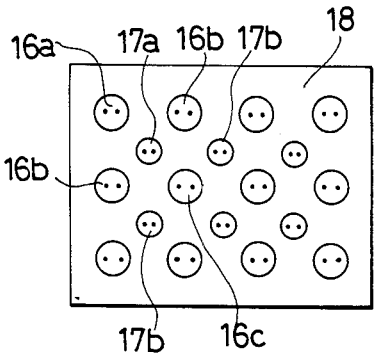
FIG. 6 is a plan view of another embodiment of the detector.
Figure 7:
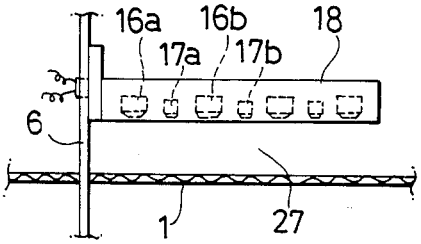
FIG. 7 is a side view of FIG. 6.

Referring to FIGS. 6 and 7 which show another embodiment of the present invention, the detector 18 has small LEDs 16*a*, 16*b*, 16*c* . . . , which are the light sources connected to the power source, and small pieces 17*a*, 17*b*, 17*c* . . . , which are regularly and alternately arranged with the LEDs on the same side of the grain exit passage 27 located at the plate end to face the mixture mass. The LEDs 16 radiate the grain mass, and the light receiving elements 17 detect the light reflected from the grain surface.

Figure 8:
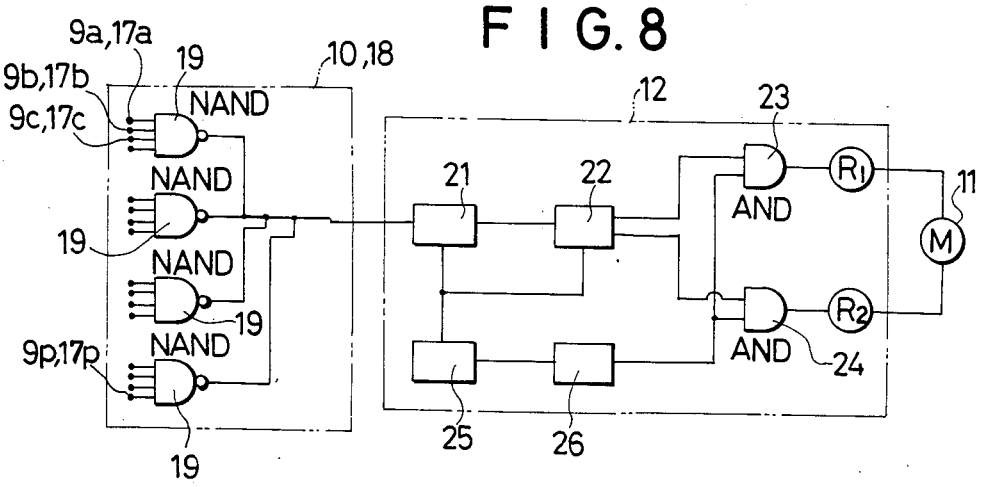
FIG. 8 is an electric circuit diagram of the control circuit.

Referring to FIG. 8, each terminal of light receiving elements 9 or 17 of detector 10 or 18 is connected to the input terminal of a NAND circuit 19, each output of said NAND circuit 19 being connected to the input of a counter circuit 21 of the control circuit 12. A clock pulse generator 25 is connected to one end of said counter circuit 21, while a transducer 22 is connected to the counter circuit output. Said clock pulse generator 25 is connected to one end of the transducer 22. The output of the transducer 22 is branched, going to one input terminal of each AND circuit 23, 24. The output of the divider 26 is connected to the other input terminal of each AND circuit 23, 24. The clock pulse generator 25 is connected to the input of said divider 26. The reversible motor 11 is connected to the output of each AND circuit 23, 24, with a normal rotation relay R1 and a reverse rotation relay R2 provided therebetween.

Accordingly, sorted grain (unpolished or unhulled rice) passing through the grain exit passage 27 facing the detector 10 or 18 in the separation wall 6 is radiated by light sources 8 or 16. The quantity of light transmitted or reflected is detected by each light receiving element 9 or 17, and a signal is fed to the primary side NAND circuits 19. Assume that said signal is generated with respect to unpolished rice and is not generated for unhulled rice. Then, when all grains detected by the light receiving elements 9*a*, 9*b* or 17*a*, 17*b* are unpolished rice, a signal is fed to each NAND circuit 19. The output side of each circuit 19 does not generate any signal, and no input is fed to the counter circuit 21. If there is a light receiving element 9 or 17 which has detected unhulled rice and output a signal, the NAND circuit 19 that has received this signal then outputs a signal which is fed to the counter circuit 21. The counter circuit 21 receives a pulse signal of any desired period (seconds) from the clock pulse generator 25, synchronizes it with the signal from the AND circuit 19, counts the frequency, and feeds the count signal to the transducer 22. The transducer 22 sends the signal to the AND circuit 23 when the frequency is larger than that arbitrarily set by the clock pulse generator 25, sends the signal to the AND circuit 24 when the frequency is smaller than set, and generates no signal when the frequency corresponds to the set value. Each AND circuit 23, 24 receives the output signal from the divider 26 connected with the clock pulse generator 25, and the AND circuit 23 actuates the relay R1 when the signals correspond, turning the motor 11 in the normal direction until the next output of the divider 26 and the transducer 22. The normal rotation of the bolt shank 14 coupled to said motor 11 moves the separation wall 6 to side R (unpolished rice mass). Relay R2 is actuated when the signal of the AND circuit 24 agrees with the output from the divider 26, when no unhulled rice is mixed with the flowing grain. The motor 11 makes a reverse turn until the next signal from the output of the divider 26 and the transducer 22; the separation wall is laterally moved toward side Q (mixed grain) by the reverse turn of the bolt shank 14 coupled with the motor 11, and the separation wall is adjusted automatically and repeatedly until the mixing ratio (3% to 5%) of different kinds of rice has reached the standard value.

When the mixing ratio of unhulled rice to unpolished rice is 3% to 5%, the ratio value being counted by the counter 21 upon detection by the light receiving elements 9 or 17, and compared to the set frequency value of transducer 22, the output signal from the transducer 22 is discontinued and the position (standard point) of the separation wall between the unhulled grain mass P and unpolished rice mass R is determined. The movement adjustment stops, and the sorting becomes stable.

The rough surface grain sorting plate may be arranged so that the front side A and the rear side B are horizontal, without raising side A as shown in FIG. 1.

I claim:

1. In a grain sorting machine of a type having a rough surface grain sorting plate, a grain exit passage of the sorting plate, a separation wall moveable along a side of said sorting plate and a drive unit communicating with the separation wall: a separation wall movement control device, comprising detector means on said separation wall and including a two-dimensional array of plural light sources and light receiving elements facing the grain exit passage and circuit means interfacing said detector means and said drive unit to position the separation wall; wherein said circuit means includes gate means responsive to said light receiving elements for generating first pulse signals; clock means for generating second pulse signals; counter means for comparing the frequency of said first count signals with the frequency of said second count signals and in response driving a bidirectional motor within said drive unit.

* * * * *